US007824279B2

(12) United States Patent
Ban et al.

(10) Patent No.: US 7,824,279 B2
(45) Date of Patent: Nov. 2, 2010

(54) GOLF CLUB HEAD

(75) Inventors: Wataru Ban, Chichibu (JP); Fumiaki Sato, Chichibu (JP); Kozue Wada, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 105 days.

(21) Appl. No.: 12/238,132

(22) Filed: Sep. 25, 2008

(65) Prior Publication Data

US 2009/0143166 A1 Jun. 4, 2009

Related U.S. Application Data

(63) Continuation-in-part of application No. 12/031,164, filed on Feb. 14, 2008, now abandoned.

(30) Foreign Application Priority Data

Nov. 30, 2007 (JP) ..... 2007-311438
Aug. 8, 2008 (JP) ..... 2008-206384

(51) Int. Cl.
*A63B 53/04* (2006.01)

(52) U.S. Cl. ..... 473/331

(58) Field of Classification Search ..... 473/330–331
See application file for complete search history.

(56) References Cited

U.S. PATENT DOCUMENTS 5,766,087 A * 6/1998 Kawamatsu ..... 473/290
6,814,673 B2 * 11/2004 Wahl et al. ..... 473/331

FOREIGN PATENT DOCUMENTS

JP 10-248974 9/1998
JP 2005-169129 6/2008

* cited by examiner

*Primary Examiner*—Stephen L. Blau
(74) *Attorney, Agent, or Firm*—Paul, Hastings, Janofsky & Walker LLP

(57) ABSTRACT

This invention provides a golf club head including a plurality of score lines on a face. In the golf club head according to this invention, the angle between each side surface of the score lines and the face is 48° or more. Edges of the score lines are formed to be positioned within a second virtual circle with a radius of 0.011 inches, the second virtual circle being concentric with a first virtual circle which internally touches the side surface of the score line and the face with a radius of 0.010 inches.

3 Claims, 11 Drawing Sheets

FIG. 9

| | W (mm) | A (mm²) | P (mm) | θa (°) | EDGE SHAPE | R1 (mm) | θb (°) | R2 (mm) | θc (°) | RULE CONFORMITY TWO-CIRCLE | RULE CONFORMITY CROSS SECTIONAL AREA | SPIN AMOUNT |
|---|---|---|---|---|---|---|---|---|---|---|---|---|
| #1 | 0.89 | 0.212 | 3.6 | 47 | NORMAL | – | – | | | ○ | ○ | D |
| #2 | | 0.227 | | 60 | | | | | | × | ○ | A |
| #11 | 0.89 | 0.227 | 3.6 | 54 | I | 0.050 | – | | | ○ | ○ | B |
| #12 | | | | 60 | | 0.100 | | | | ○ | ○ | B |
| #13 | | 0.300 | | 70 | | 0.050 | | | | × | × | A |
| #14 | | 0.227 | | | | | | | | × | ○ | B |
| #15 | | | | | | 0.150 | | | | ○ | ○ | D |
| #16 | | | 2.7 | | | 0.200 | | | | ○ | × | B |
| #21 | 0.89 | 0.227 | 3.6 | 65 | II | – | 10 | – | | × | ○ | C |
| #22 | | | | | | | 40 | | | ○ | ○ | B |
| #23 | | | | | | | 60 | | | × | ○ | A |
| #24 | | | | 75 | | | 20 | | | × | ○ | C |
| #25 | | | | | | | 40 | | | ○ | ○ | B |
| #26 | | | | | | | 60 | | | × | ○ | A |
| #31 | 0.89 | 0.227 | 3.6 | 65 | III | – | – | 0.4 | 15 | × | ○ | C |
| #32 | | | | | | | | | 40 | ○ | ○ | B |
| #33 | | | | | | | | | 60 | × | ○ | A |
| #34 | | | | 75 | | | | | 20 | × | ○ | C |
| #35 | | | | | | | | | 40 | ○ | ○ | B |
| #36 | | | | | | | | | 60 | × | ○ | A |
| #37 | | | | 65 | | | | 0.2 | 15 | × | ○ | C |
| #38 | | | | | | | | | 40 | ○ | ○ | B |
| #39 | | | | | | | | | 60 | × | ○ | A |
| #40 | | | | 75 | | | | | 25 | × | ○ | C |
| #41 | | | | | | | | | 40 | ○ | ○ | B |
| #42 | | | | | | | | | 60 | × | ○ | A |

GOLF CLUB HEAD

This is a continuation-in-part application of U.S. patent application Ser. No. 12/031,164 filed on Feb. 14, 2008, entitled "GOLF CLUB HEAD".

BACKGROUND OF THE INVENTION

1. Field of the Invention

The present invention relates to a golf club head and, more particularly, to score lines on the face.

2. Description of the Related Art

Generally, on the face of a golf club head, a plurality of straight grooves are formed parallel to each other in the toe-and-heel direction (see, e.g., Japanese Patent Laid-Open Nos. 10-248974 and 2005-169129). These grooves are called score lines, marking lines, face lines, or the like (to be referred to as score lines in this specification). These score lines have an effect of increasing the back spin amount of a shot or suppressing a significant decrease in the back spin amount of a shot in the case of a rainy day or a shot from rough.

As a rule about score lines of a golf club head for competitions, each edge of a score line must be positioned within a virtual circle with a radius of 0.011 inches concentric with a virtual circle with a radius of 0.010 inches which internally touches the side surface of the score line and the face (to be referred to as a two-circle rule, hereinafter).

In order to satisfy the two-circle rule, however, it is necessary to decrease the angle between each side surface of the score lines and the face. In this case, the edge angle of the score line increases, resulting in not only a decrease in spin amount but also a decrease in the volume of the score line. Accordingly, a spin amount may significantly decrease in case of a shot from rough or a shot in a rainy day.

SUMMARY OF THE INVENTION

It is an object of the present invention to provide a golf club head which can provide the higher spin amount while conforming to the two-circle rule.

According to the present invention, there is provided a golf club head including a plurality of score lines on a face, wherein an angle between each side surface of the score lines and the face is not less than 48 degrees, and edges of the score lines are formed to be positioned within a second virtual circle with a radius of 0.011 inches, the second virtual circle being concentric with a first virtual circle which internally touches the side surface of the score line and the face with a radius of 0.010 inches.

Further features of the present invention will become apparent from the following description of exemplary embodiments (with reference to the attached drawings).

BRIEF DESCRIPTION OF THE DRAWINGS

FIG. 9 is a table showing the specifications of score line, rule conformance, and spin amount of golf club heads #1 to #42 used in the test.

DESCRIPTION OF THE EMBODIMENTS

First Embodiment

Figure 1:
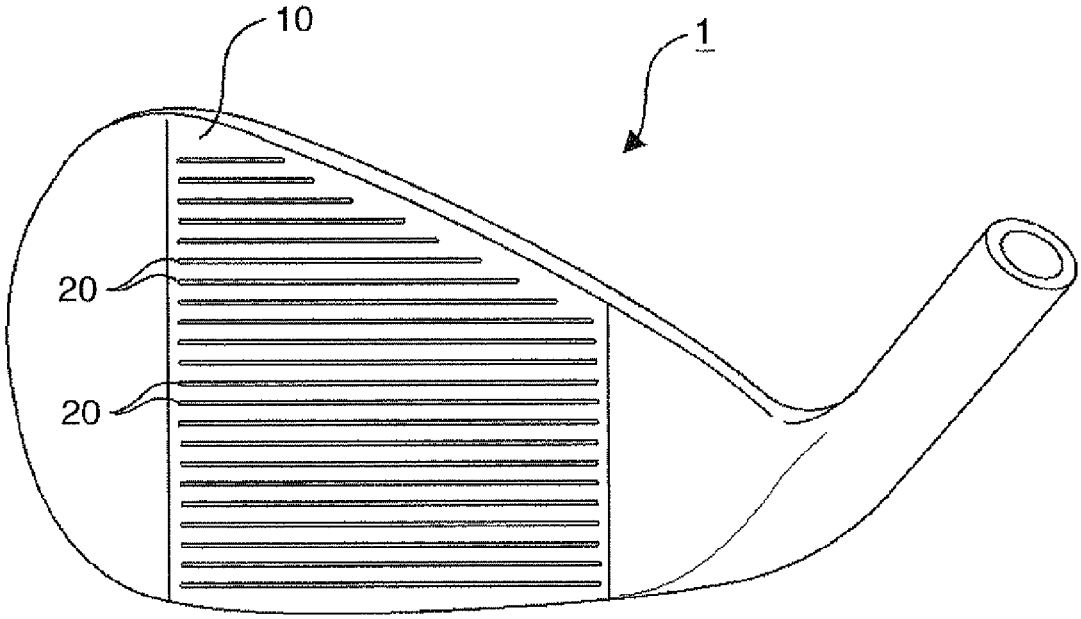
FIG. 1 is a view showing the outer appearance of a golf club head 1 according to an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for iron golf club heads, and particularly for middle iron golf club heads, short iron golf club heads, and wedge iron golf club heads. More specifically, the present invention is suitable for golf club heads with a loft angle of 30° to 70° (both inclusive) and a head weight of 240 g to 320 g (both inclusive). However, the present invention is also applicable to wood or utility golf club heads.

The golf club head 1 has a plurality of score lines 20 formed on its face 10. The respective score lines 20 are straight grooves extending in the toe-and-heel direction and parallel to each other. In this embodiment, the respective score lines 20 are arranged at an equal interval (equal pitch) but they may be arranged at different intervals.

Figure 2A:
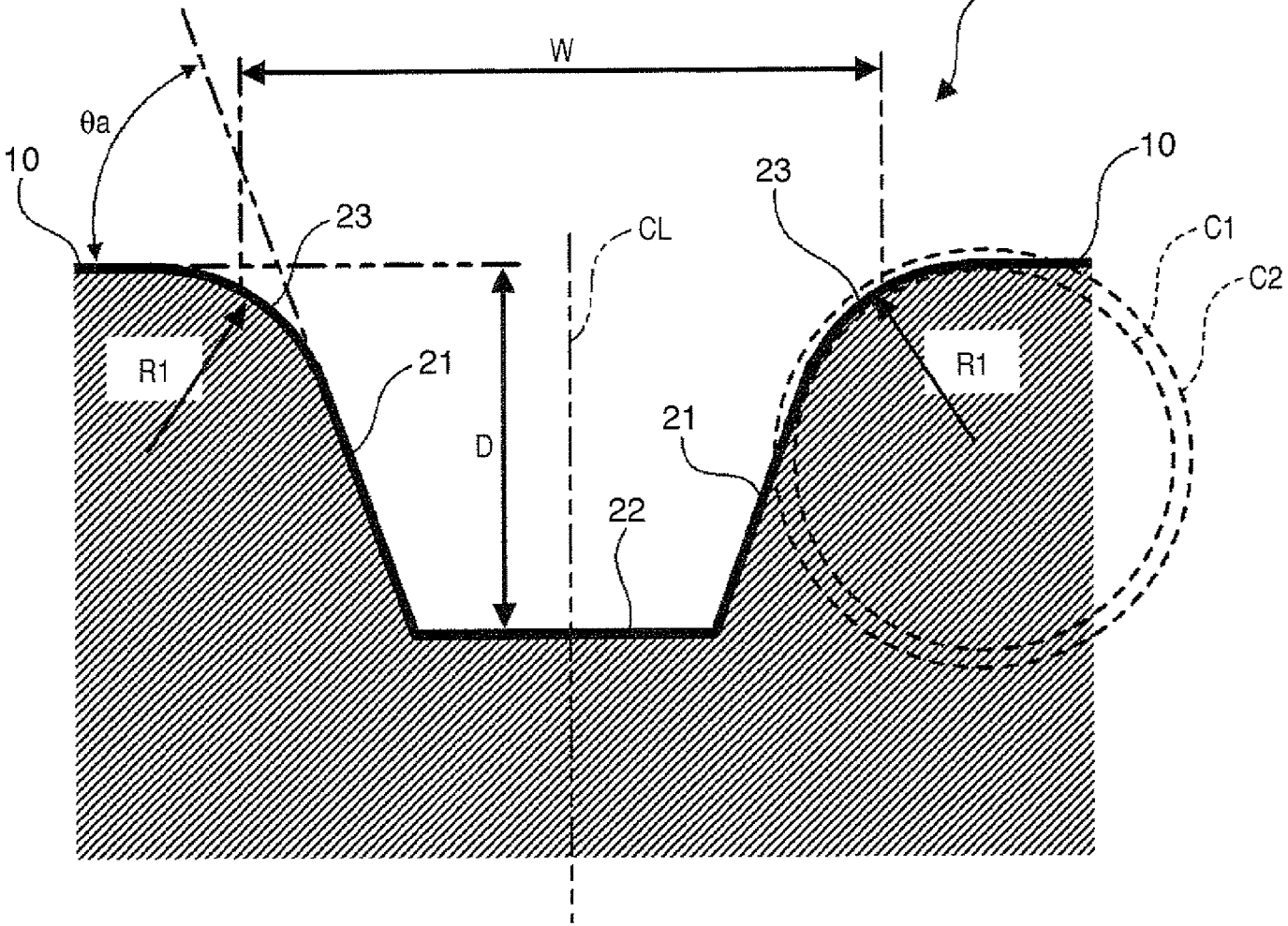
FIG. 2A is a sectional view of a score line 20 in a direction perpendicular to the longitudinal direction (toe-and-heel direction)

FIG. 2A is a sectional view showing the score line 20 in a direction perpendicular to the longitudinal direction (toe-and-heel direction). In this embodiment, the cross sectional shapes of the score lines 20 are the same except in two end portions in the longitudinal direction. The score lines 20 have the same cross sectional shape.

The score line 20 has a pair of side surfaces 21 and a bottom surface 22. In this embodiment, the cross sectional shape of the score line 20 is almost a trapezoid, but it may be a V-shape or U-shape. A rounding 23 with a radius R1 is formed in each edge (the boundary portion of the side surface 21 and face 10) of the score line 20. The cross sectional shape of the rounding 23 is a circular arced shape.

The cross sectional shape of the score line 20 is symmetric with respect to a center line CL. A width W indicates the width of the score line 20 measured based on the so-called 30 degrees measurement rule as a rule for golf clubs for competitions. Note that a distance S between the respective score lines 20 (the distance between the end points of the adjacent score lines 20, that are specified based on the 30 degrees measurement rule) is three or more times larger than the width W and 0.075 inches (1.905 mm) or more in accordance with the rules for golf club heads for competitions. A depth D is the length from the face 10 to the bottom surface 22, and is 0.020 inches (0.508 mm) or less. An angle θa is the angle between the side surface 21 and face 10, which is 48° to 90° (both inclusive) in this embodiment.

Figure 10:
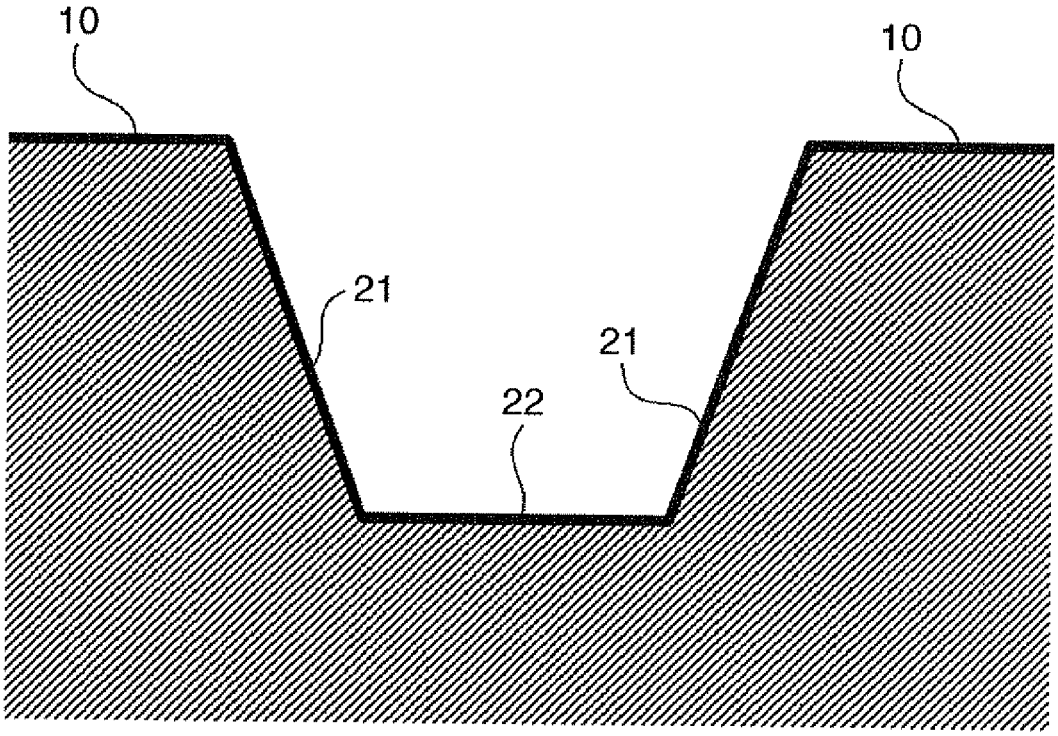
FIG. 10 is a sectional view showing an example in which each edge of a score line 20 has a square shape formed by a side face 21 and a face 10.

A virtual circle C1 is a circle with a radius of 0.010 inches which internally touches the side surface 21 and face 10. A virtual circle C2 is a circle with a radius of 0.011 inches which is concentric with the virtual circle C1. In order to conform to the two-circle rule described above, the edge of the score line 20 needs to be positioned within the second circle C2. However, in order to conform to the two-circle rule, if the edge of the score line 20 has a square shape formed by the side surface 21 and face 10 as shown in FIG. 10, the angle θa must be decreased. More specifically, the angle θa must be smaller than 48°. In this case, the edge angle (180°−θa) of the score line 20 increases, resulting in not only a decrease in spin amount but also a decrease in the volume of the score line 20. Accordingly, the spin amount may significantly decrease in the case of a shot from rough or a shot on a rainy day.

To solve this problem, in this embodiment, the angle θa is set to 48° or more, and a rounding 23 with a radius R1 is formed in each edge of the score line 20 such that it is positioned within the virtual circle C2. With this arrangement, the higher spin amount can be obtained while conforming to the two-circle rule. In order to conform to the two-circle rule, there is a certain relationship between the angle θa and the radium R1 of the rounding 23. When the radius R1 is 0.05 mm, the angle θa is about 54° or less. When the radius R1 is 0.1 mm, the angle θa is about 60° or less. When the radius R1 is 0.15 mm, the angle θa is about 70° or less.

When the angle θa is increased, the volume of the score line 20 increases. In this case, a significant decrease in spin amount in the case of a shot from rough or a shot on a rainy day can be prevented, but the radius R1 also increases. When the radius R1 increases, the spin amount decreases. Therefore, it is preferable that the radius R1 is 0.1 mm or less and the angle θa is 60° or less at the same time.

As a method of forming the score lines 20, cutting, forging, casting, or the like is available. The roundings 23 may be formed by cutting after forming the score lines 20 with the shape shown in FIG. 10.

Second Embodiment

Figure 3:
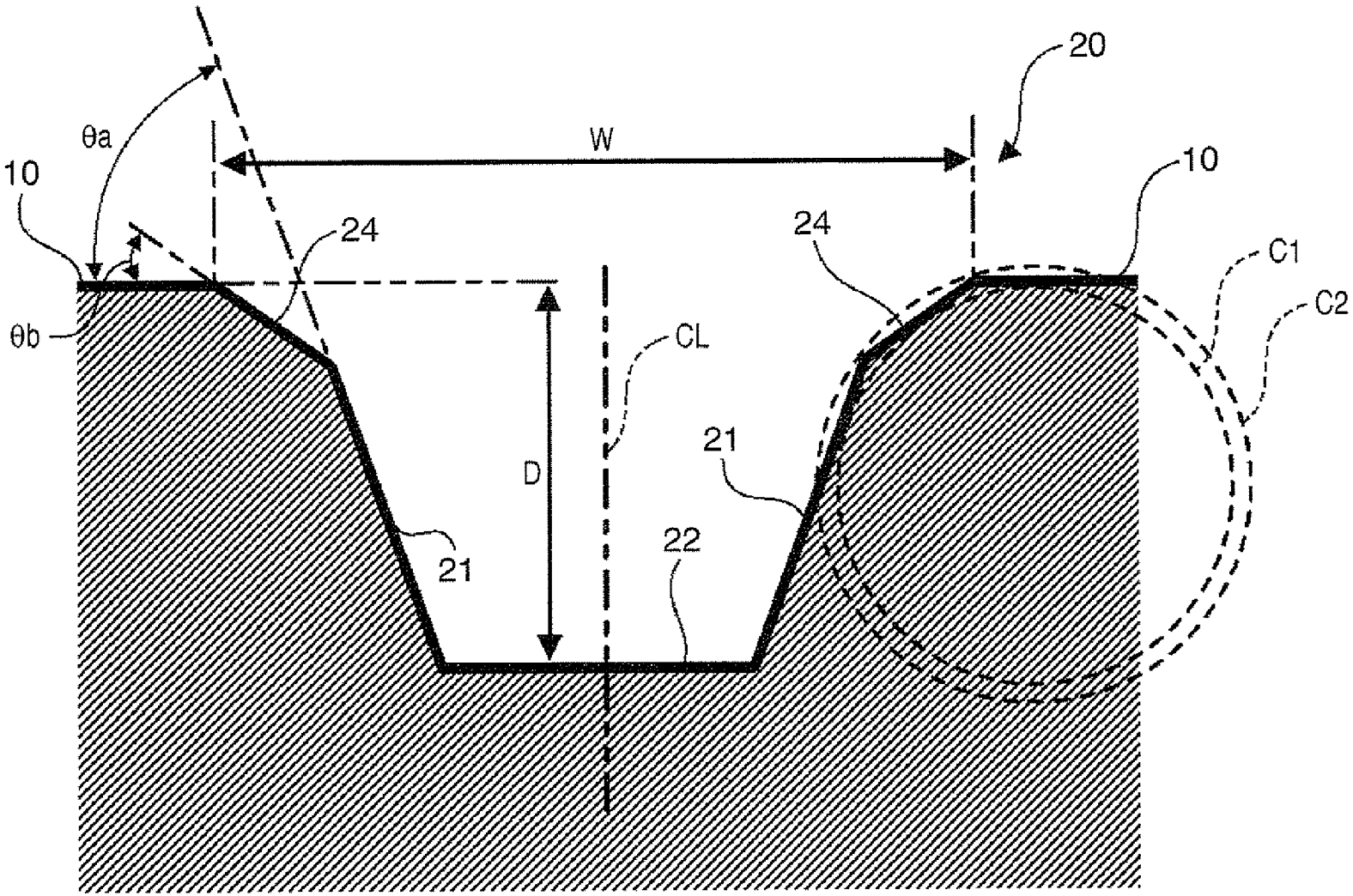
FIG. 3 is a sectional view of a score line 20 in the second embodiment of the present invention in a direction perpendicular to the longitudinal direction (toe-and-heel direction)

In the first embodiment described above, the rounding 23 is formed in each edge of the score line 20. However, as shown in FIG. 3, a flat surface 24 inclined against both of a face 10 and a side surface 21 of a score line 20 may be formed. The flat surface 24 is uniformly formed in the longitudinal direction of the score line 20. The cross sectional shape of the score line 20 is symmetric with respect to a center line CL.

An angle θb is the angle between the face 10 and flat surface 24. The definitions of a width W, an angle θa, a depth D, and virtual circles C1 and C2 are the same as in the first embodiment described above.

Figure 4:
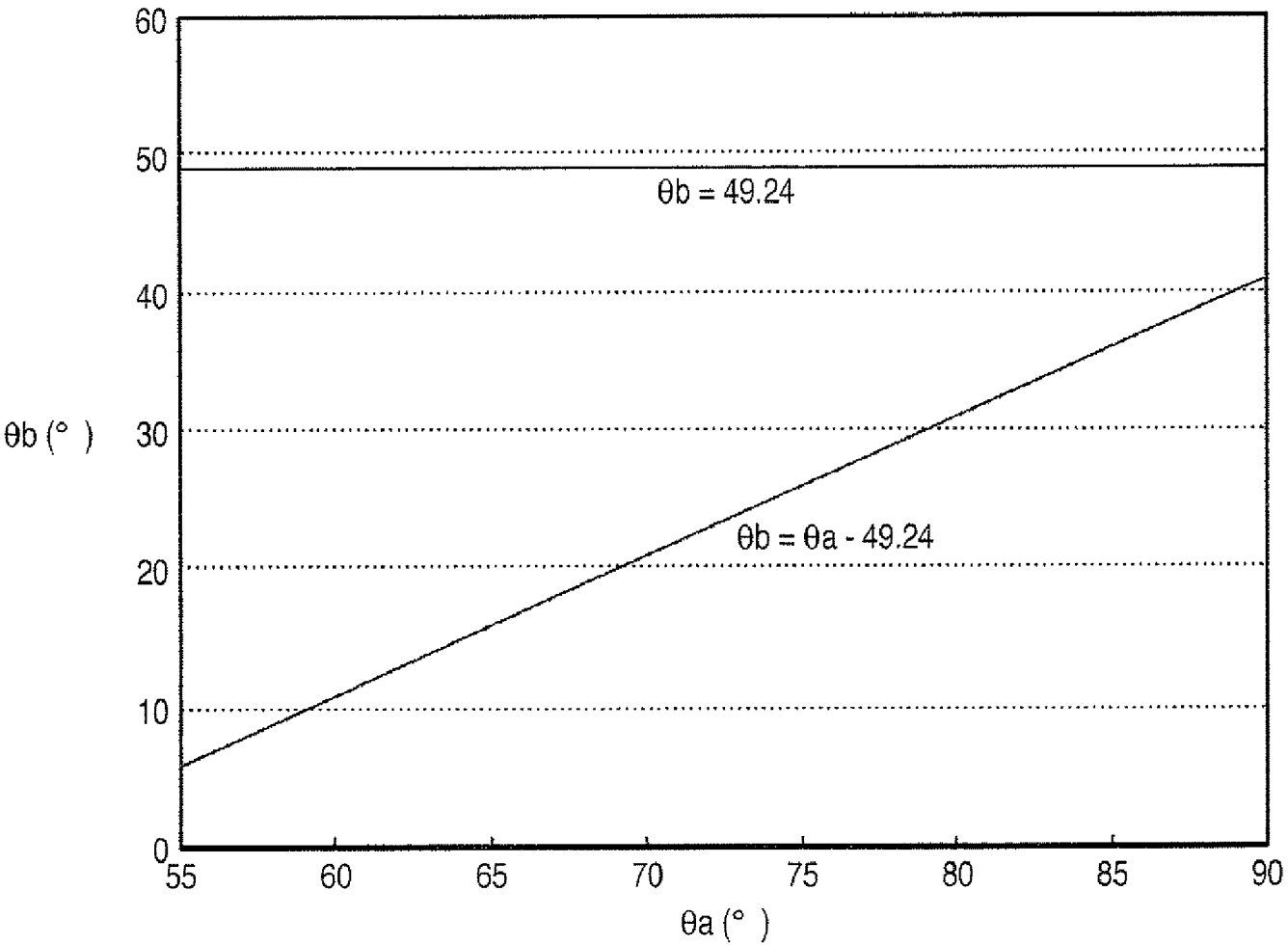
FIG. 4 is a graph showing the combination of an angle θa and an angle θb, which conforms to the two-circle rule.

The angle θa is set to 48° or more in this embodiment as well. The flat surface 24 is formed in each edge of the score line 20 such that it is positioned within the virtual circle C2. With this arrangement, the higher spin amount can be obtained while conforming to the two-circle rule. When the angle θb is increased, the spin amount increases. However, in order to conform to the two-circle rule, the angle θb is 49.24° at its maximum. Accordingly, the combination of the angles θa and θb to conform to the two-circle rule falls within the range between the line representing θb=49.24 and the line representing θb=θa−49.24, as shown in FIG. 4.

As a method of forming the score lines 20 in this embodiment, cutting, forging, casting, or the like is available. The flat surfaces 24 may be formed by cutting after forming the score lines 20 with the shape shown in FIG. 10.

Third Embodiment

Figure 5:
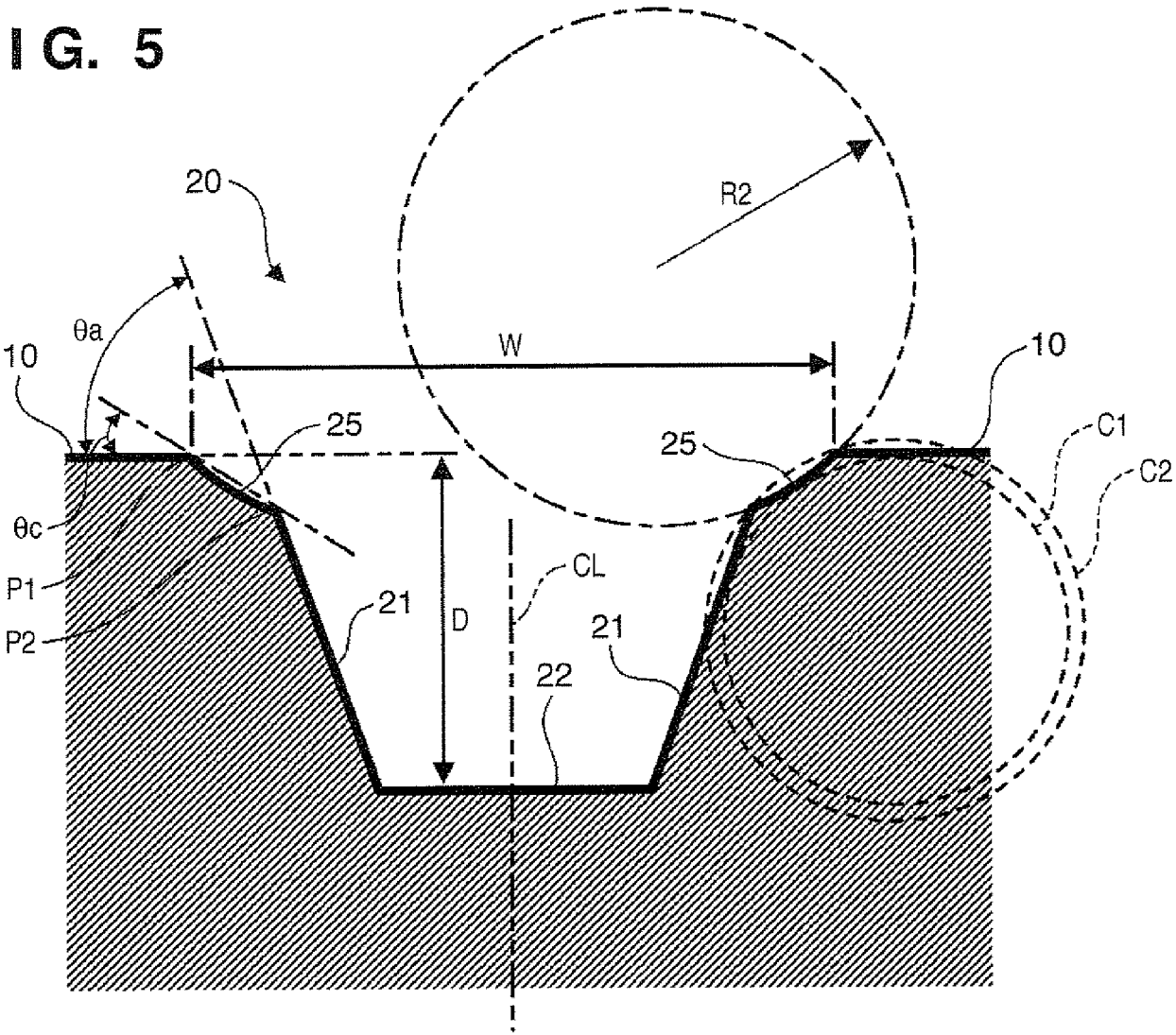
FIG. 5 is a sectional view of a score line 20 in the third embodiment of the present invention in a direction perpendicular to the longitudinal direction (toe-and-heel direction)

In the first embodiment described above, the rounding 23 is formed in each edge of the score line 20. However, a notch 25 may be formed as shown in FIG. 5. In the example shown in FIG. 5, the cross sectional shape of the notch 25 is a circular arced shape with a radius R2. The cross sectional shape of the notch 25 may be an oval arced shape or the like other than a circular arced shape, as long as it is an arced shape. The notch 25 is uniformly formed in the longitudinal direction of a score line 20. The cross sectional shape of the score line 20 is symmetric with respect to a center line CL.

An angle θc is the angle between a line which connects end points P1 and P2 of the notch 25 and the face 10. The definitions of a width W, an angle θa, a depth D, and virtual circles C1 and C2 are the same as in the first embodiment described above.

The angle θa is set to 48° or more in this embodiment as well. The notch 25 is formed in each edge of the score line 20 such that it is positioned within the virtual circle C2. With this arrangement, the higher spin amount can be obtained while conforming to the two-circle rule. When the radius R2 is decreased, the spin amount increases. When the angle θc is increased, the spin amount increases.

Figure 6:
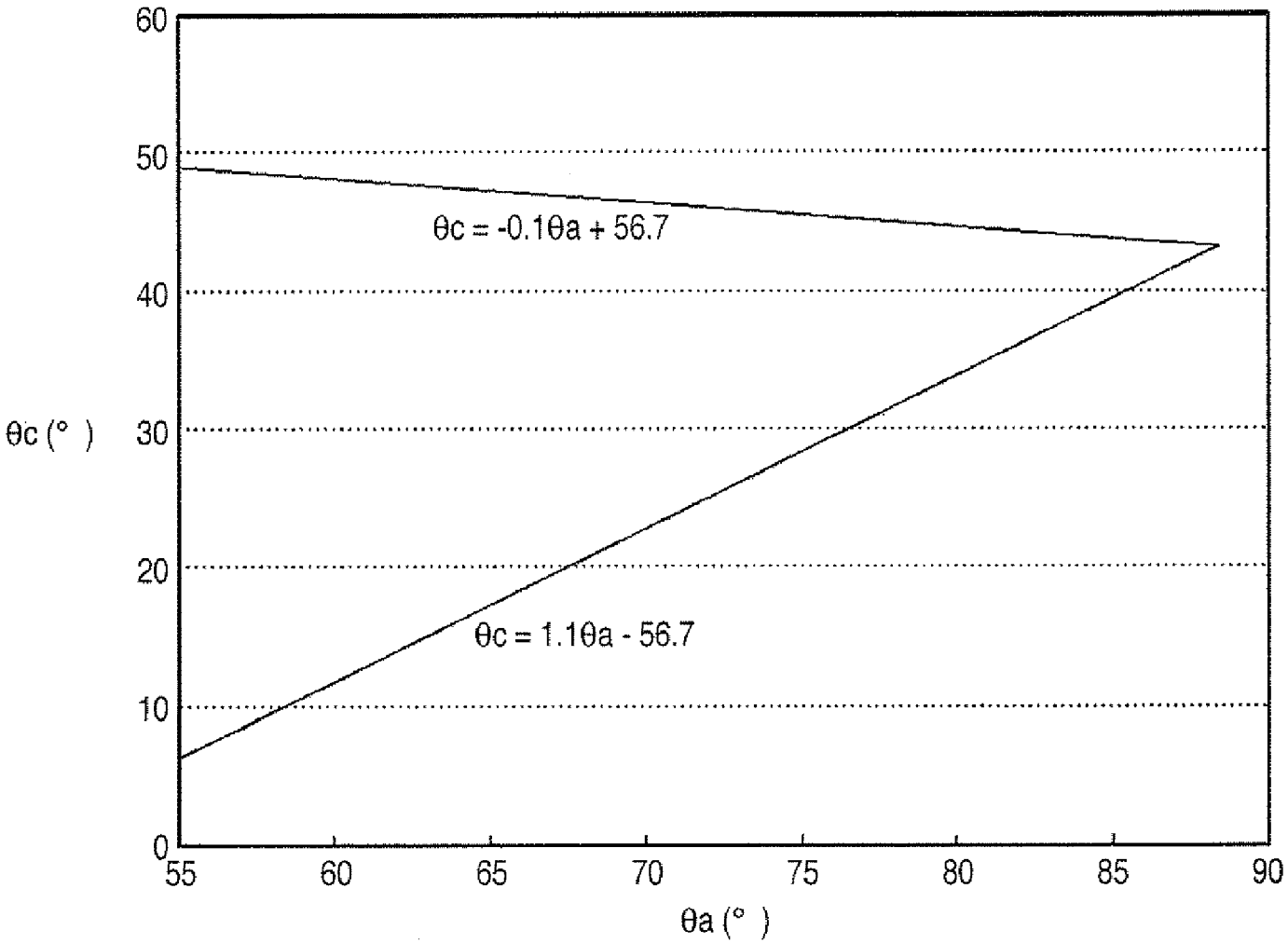
FIG. 6 is a graph showing the combination of an angle θa and an angle θb, which conforms to the two-circle rule when a radius R2 is 0.4 mm.
Figure 7:
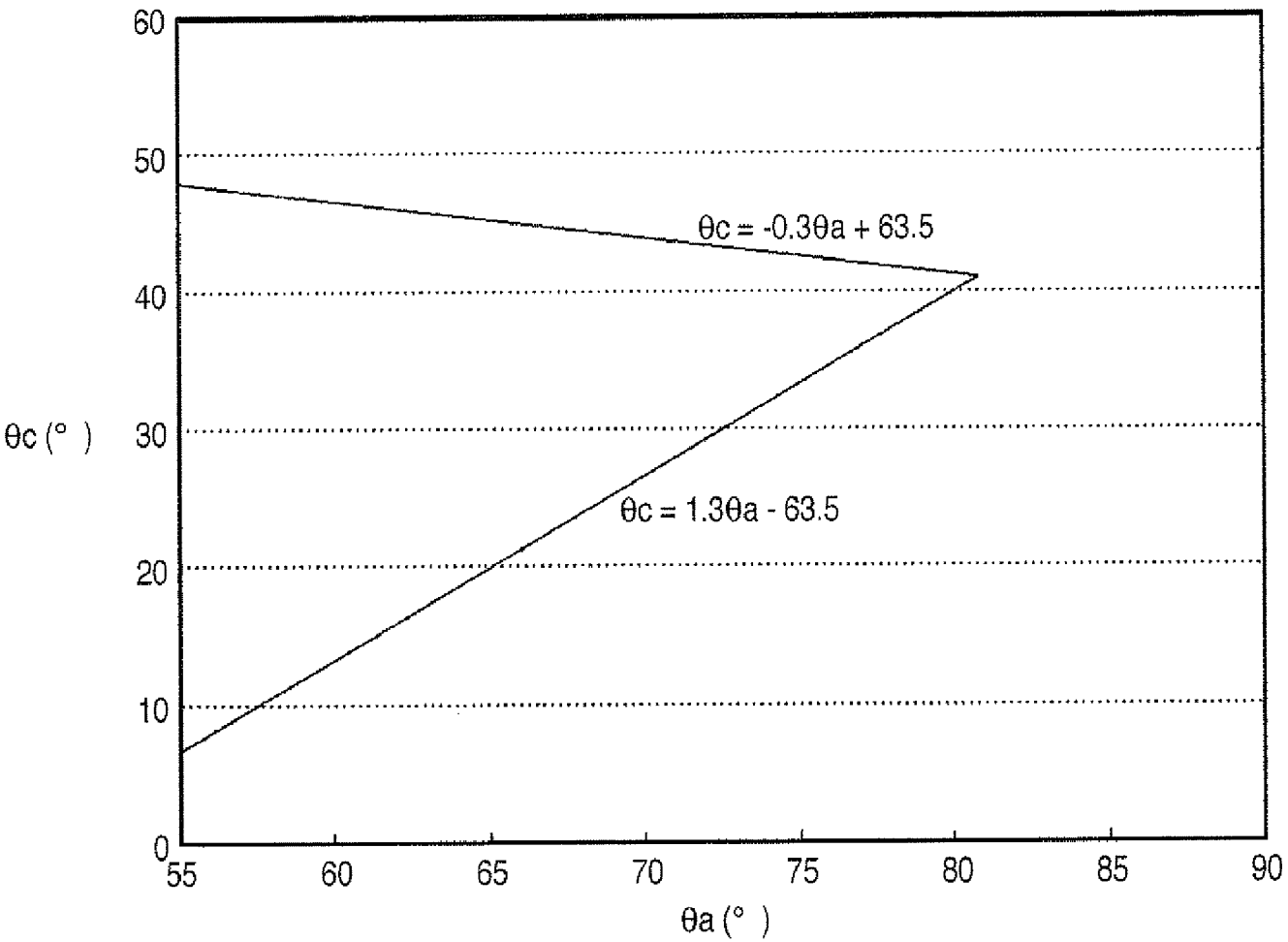
FIG. 7 is a graph showing the combination of the angle θa and the angle θb, which conforms to the two-circle rule when the radius R2 is 0.2 mm.

In order to conform to the two-circle rule, there is a certain relationship between the radius R2, angle θc, and angle θa. FIG. 6 shows the combination of the angles θa and θb, which conforms to the two-circle rule when the radium R2 is 0.4 mm. In this case, this combination falls within the range between the line representing θc=−0.1θa+56.7 and the line representing θc=1.1θa−56.7. FIG. 7 shows the combination of the angles θa and θb, which conforms to the two-circle rule when the radius R2 is 0.2 mm. In this case, this combination falls within the range between the line representing θc=−0.3θa+63.5 and the line representing θc=1.3θa−63.5.

As a method of forming the score lines 20 in this embodiment, cutting, forging, casting, or the like is available. The notches 25 may be formed by cutting after forming the score lines 20 with the shape shown in FIG. 10.

Fourth Embodiment

Figure 8:
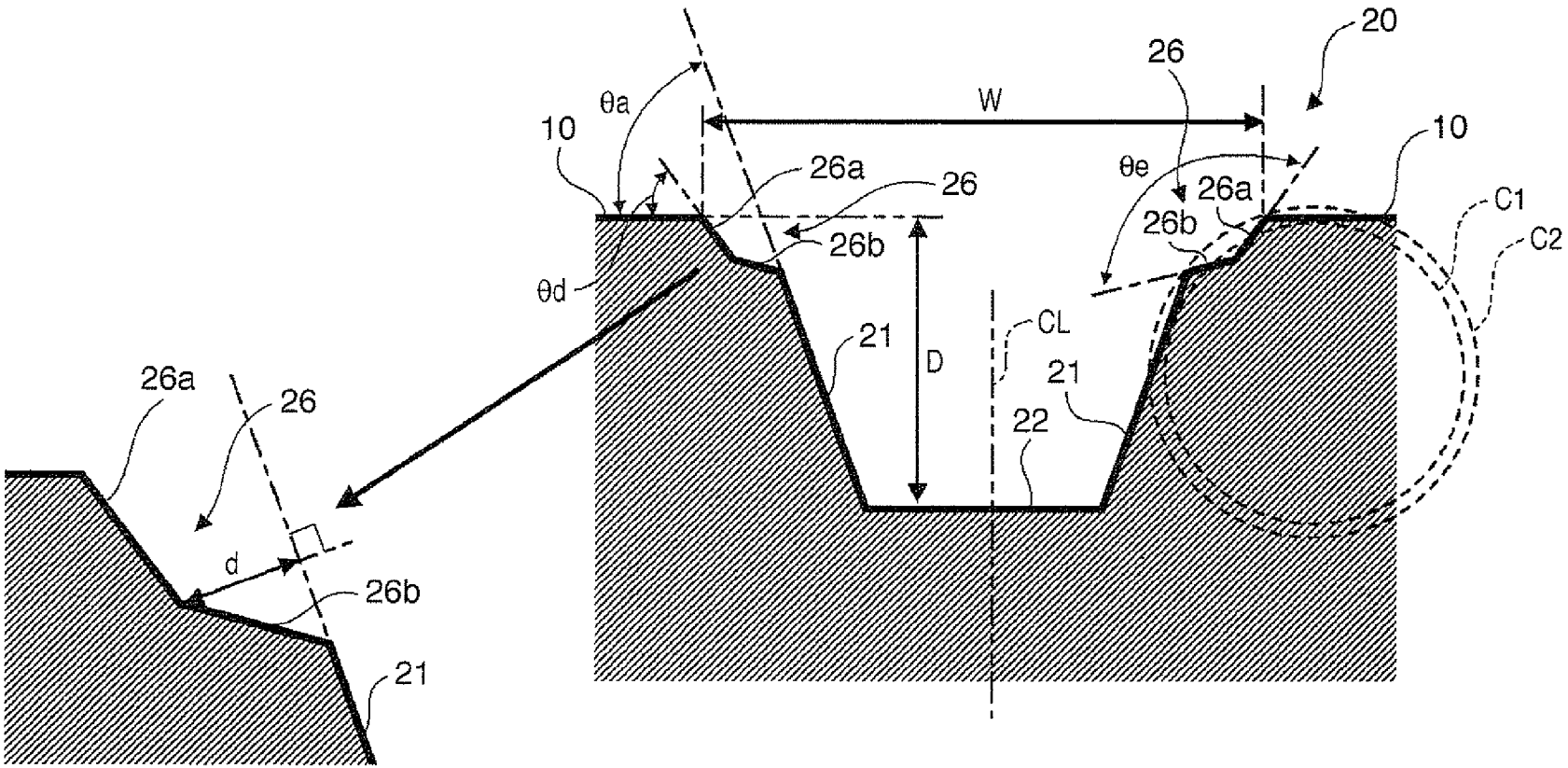
FIG. 8 shows a sectional view of a score line 20 in the fourth embodiment of the present invention in a direction perpendicular to the longitudinal direction (toe-and-heel direction) and its partially enlarged view.

In the third embodiment described above, the cross sectional shape of the notch 25 is an arced shape. However, a notch 26 with another cross sectional shape may be formed as shown in FIG. 8. In the example shown in FIG. 8, the notch 26 has a side surface 26*a* leading to a face 10 and a side surface 26*b* leading to the side surface 26*a* and a side surface 21 of the score line 20. The side surfaces 26*a* and 26*b* are flat surfaces, respectively. In this embodiment, no rounding is formed at the intersection point of the side surfaces 26*a* and 26*b*, but a rounding may be formed there. The notch 26 is uniformly formed in the longitudinal direction of the score line 20. The cross sectional shape of the score line 20 is symmetric with respect to a center line CL.

An angle θd is the angle between the side surface 26*a* and face 10, and an angle θe is the angle between the side surfaces 26*a* and 26*b*. A depth d is the length of the normal from the intersection point of the side surfaces 26*a* and 26*b* to the side surface 21 of the score line 20. The definitions of a width W, an angle θa, a depth D, and virtual circles C1 and C2 are the same as in the first embodiment described above.

The angle θa is set to 48° or more in this embodiment as well. The notch 26 is formed in each edge of the score line 20 such that it is positioned within the virtual circle C2. With this arrangement, the higher spin amount can be obtained while conforming to the two-circle rule. In order to conform to the two-circle rule, the angle θd is 49.6° to 90° (both inclusive).

As a method of forming the score lines 20 in this embodiment, cutting, forging, casting, or the like is available. The notches 26 may be formed by cutting after forming the score lines 20 with the shape shown in FIG. 10. In this case, the amount of cutting can be decreased by setting the depth D to 0.1 mm or less.

EXAMPLES

Golf club heads #1 to #42 having different specifications of score line were fabricated. FIG. 9 is a table showing the specifications of score lines, rule conformance, and spin amounts for golf club heads #1 to #42.

Figure 2B:
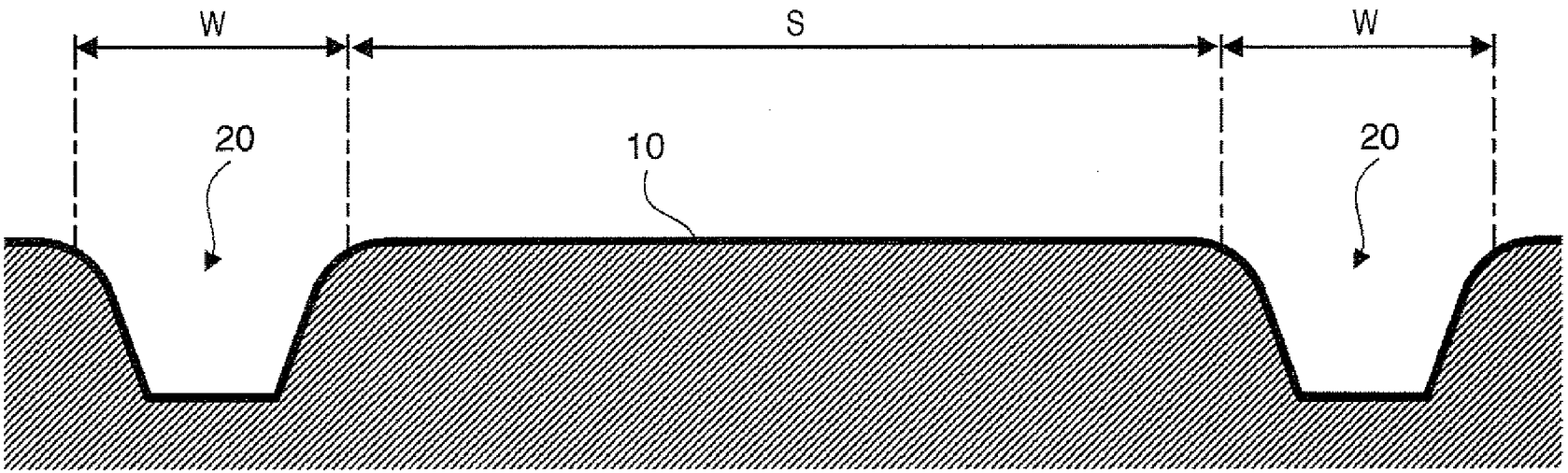
FIG. 2B is a view for explaining a distance S between the score lines 20.

In FIG. 9, "W" indicates the width of the score line, which is the width W measured based on the 30 degrees measurement rule described above. "A" indicates the cross sectional area of the score line. "P" indicates the pitch of the score lines, which is the length obtained by adding the distance S (see FIG. 2B) and the width W described above. That is, P=S+W. "θa" indicates the angle θa described above. "Edge shape" indicates the type of the cross sectional shape of the edge of the score line, in which "normal" indicates the shape shown in FIG. 10, "I" indicates the shape in the first embodiment described above, "II" indicates the shape in the second embodiment described above, and "III" indicates the shape in the third embodiment described above.

"R1" indicates the radius R1 described above, "θb" indicates the angle θb described above, "R2" indicates the radius R2 described above, and "θc" indicates the angle θc described above. "Rule conformity" indicates the conformity to the rule about a golf club head for competitions, in which "2-circle" indicates the two-circle rule described above. That is, when the edge of the score line is positioned within a virtual circle with a radius of 0.011 inches concentric to a virtual circle with a radius of 0.010 inches which internally touches the side surface of the score line and the face, this golf club head conforms to the two-circle rule. Otherwise, the golf club head does not conform to the two-circle rule. "Cross sectional area" indicates the rule about the cross sectional area of a score line. This rule defines that cross sectional area/pitch $P \leqq 0.003$ ($inch^2$/inch) (0.0762 ($mm^2$/mm)). In order to make the golf club head as a golf club head for competitions, it needs to be designed to satisfy the rule. If the golf club head is designed so as to satisfy a cross sectional area/pitch $P \leqq 0.0025$ ($inch^2$/inch), the golf club head can be better insured to meet the rule.

"Spin amount" indicates the evaluation obtained by hitting a ball using a golf club mounted with each of golf club heads #1 to #42, actually measuring the spin amount of the shot, and evaluating the spin amount with four levels. "A" indicates the highest spin amount and "D" indicates the lowest spin amount.

In golf club heads #1 and #2, the cross sectional shape of the edge of the score line is that in FIG. 10. In golf club head #1, the angle θa is 47°, which conforms to the two-circle rule, but the spin amount is low. That is, obviously, the spin amount is poor when the angle θa is smaller than 48°. In golf club head #2, the spin amount is high but the angle θa is 60°, which does not conform to the two-circle rule.

In golf club heads #11 to #16, the cross sectional shape of the edge of the score line is that in the first embodiment described above. In order to conform to the two-circle rule, the radius R1 obviously needs to be increased as the angle θa increases. Golf club head #15 with the radius R1 of 0.150 mm had a low spin amount, but golf club head #12 with the radius R1 of 0.100 mm had a slightly high spin amount. Accordingly, the radius R1 is preferably 0.100 mm or less. In this case, in order to conform to the two-circle rule, the angle θa is 60° or less. In golf club head #16, the radius R1 was set to 0.200 mm but the pitch P was decreased to increase the spin amount. However, this does not conform to the cross sectional area rule.

In golf club heads #21 to #26, the cross sectional shape of the edge of the score line is that in the second embodiment described above. As the angle θb increases, the spin amount increases, but the golf club head becomes not to conform to the two-circle rule. In addition, the golf club head may not conform to the two-circle rule in association with the angle θa when the angle θb is excessively small.

The angles θa and θb are advantageously larger from the viewpoint of the spin amount. Accordingly, by increasing the angles θa and θb within the range shown in FIG. 4, the higher spin amount can be obtained while conforming to the two-circle rule.

In golf club heads #31 to #42, the cross sectional shape of the edge of the score line is that in the third embodiment described above. As the angle θc increases, the spin amount increases, but the golf club head will not to conform to the two-circle rule. The golf club head may not conform to the two-circle rule in association with the angle θa when the angle θc is excessively small. The angle θc is advantageously larger from the viewpoint of the spin amount. Accordingly, by increasing the angle θc within the range shown in FIGS. 6 and 7 and based on the relationship with the radius R2 and angle θa, the higher spin amount can be obtained while conforming to the two-circle rule.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-311438, filed Nov. 30, 2007 and No. 2008-206384, filed Aug. 8, 2008, which are hereby incorporated by reference herein in their entirety.

What is claimed is:

1. A golf club head including a plurality of score lines on a face, wherein an angle between each side surface of said score lines and said face is not less than 48 degrees, edges of said score lines are formed to be positioned within a second virtual circle with a radius of 0.011 inches, the second virtual circle being concentric with a first virtual circle which internally touches said side surface and said face with a radius of 0.010 inches, and wherein a cross sectional shape of each edge of said score lines is a circular arced shape with a radius not more than 0.1 mm.

2. The golf club head according to claim 1, wherein a cross section area A ($inch^2$) of said score line, a width W (inch) of said score line measured based on the 30 degrees measurement rule and a distance S (inch) between said score lines adjacent one another satisfy the following expression:

$$A/(W+S) \leqq 0.003.$$

3. The golf club head according to claim 1, wherein a cross section area A ($inch^2$) of said score line, a width W (inch) of said score line measured based on the 30 degrees measurement rule and a distance S (inch) between said score lines adjacent one another satisfy the following expression:

$$A/(W+S) \leqq 0.0025.$$

* * * * *